US010202263B2

(12) United States Patent
Xiao

(10) Patent No.: US 10,202,263 B2
(45) Date of Patent: Feb. 12, 2019

(54) MANUFACTURING METHOD FOR BELT AXLE CONNECTING PIECE OF WINCH

(71) Applicant: Zhaoyin Xiao, Taizhou (CN)

(72) Inventor: Zhaoyin Xiao, Taizhou (CN)

(73) Assignee: Zhejiang Topsun Logistic Control Co., Ltd., Taizhou (CN)

( * ) Notice: Subject to any disclaimer, the term of this patent is extended or adjusted under 35 U.S.C. 154(b) by 621 days.

(21) Appl. No.: 14/959,210

(22) Filed: Dec. 4, 2015

(65) Prior Publication Data

US 2016/0083231 A1 Mar. 24, 2016

Related U.S. Application Data

(62) Division of application No. 14/059,378, filed on Oct. 21, 2013, now Pat. No. 9,643,824.

(30) Foreign Application Priority Data

Dec. 3, 2012 (CN) ..... 2012 1 0516106

(51) Int. Cl.
*B66D 1/00* (2006.01)
*B66D 1/28* (2006.01)
*B66D 1/34* (2006.01)

(52) U.S. Cl.
CPC *B66D 1/28* (2013.01); *B66D 1/34* (2013.01)

(58) Field of Classification Search
CPC ..... B66D 1/28; B66D 1/34
See application file for complete search history.

(56) References Cited

U.S. PATENT DOCUMENTS

| | | | | |
|---|---|---|---|---|
| 5,954,294 | A | 9/1999 | Forsner | |
| 2007/0267611 | A1 | 11/2007 | Leone et al. | |
| 2009/0308826 | A1* | 12/2009 | Kempf | B66C 9/02 212/270 |
| 2013/0020271 | A1* | 1/2013 | Nero | B66D 1/30 211/85.5 |
| 2013/0270498 | A1* | 10/2013 | Burneister | B66D 1/28 254/266 |
| 2013/0334479 | A1* | 12/2013 | Yoder | B66D 1/34 254/266 |
| 2014/0027691 | A1* | 1/2014 | Ilaka | B66D 1/30 254/334 |
| 2016/0090279 | A1* | 3/2016 | Hausladen | B66D 1/22 254/340 |

FOREIGN PATENT DOCUMENTS

CN 201020298532.5 4/2011

* cited by examiner

*Primary Examiner* — Richard Chang
(74) *Attorney, Agent, or Firm* — Minder Law Group; Willy H. Wong

(57) ABSTRACT

The invention provides a belt axle connecting piece of a winch and a manufacturing method in the field of mechanical technologies. The winch comprises a bracket and a belt axle axially arranged on the winch, wherein the belt axle includes three rods arranged along the axial direction. Bundling belts or ropes can be placed within the clearance between any two adjacent rods. The belt axle connecting piece comprises a cylindrical body, with three bent positioning petals arranged at one end of the body. Every two adjacent positioning petals form positioning holes for securing the rods to the bracket. The connecting piece is simple in structure, sturdy, and easy to manufacture.

6 Claims, 4 Drawing Sheets

MANUFACTURING METHOD FOR BELT AXLE CONNECTING PIECE OF WINCH

RELATED APPLICATIONS

This application is a divisional of U.S. patent application Ser. No. 14/059,378, filed Oct. 21, 2013, and claims benefit to Chinese Patent Application No. 201210516106.8, filed Dec. 3, 2012.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to a belt axle connecting piece of a winch in the field of mechanical technologies.

Related Art

Winches are commonly used for elevating, lowering, and dragging materials in a wide variety of applications, including construction, hydraulic engineering, forestry, and mining, and are particularly widely utilized in the field of transportation. Winches have a large lifting capacity and are versatile, compact, lightweight, and portable. By using the winch, heavy goods can be moved by a relatively small staff of workers.

Previous conventional winches had issues with poor engagement between the pawl and the ratchet wheel, as well as low precision in binding. In order to address the problems of these previous winches, recent winches have been designed for stability and safety. For example, a contemporary winch is depicted in Chinese Patent No. 201020298532.5. However, this winch has only one rotary shaft and the bundling belt does not reliably engage with the rotary shaft, leading to slippage problems that may ultimately lead to accidents.

In addition, conventional winches use solid connecting structures to affix the rotary shaft to the bracket frame. These solidly casted connecting pieces are difficult and costly to manufacturer. Moreover, in colder conditions, ice and snow can build up around the rotary shaft and the bracket, freezing the rotary shaft and connecting pieces. The subsequent expansion of the ice and snow can force the rotary shaft off of the bracket.

SUMMARY OF THE INVENTION

It is an object of an embodiment of the invention to overcome the disadvantages of the prior art discussed above.

It is another object of an embodiment of the invention to provide a safe and stable winch.

It is another object of an embodiment of the invention to provide a winch that reliably engages the bundling belt and prevents slippage.

It is another object of an embodiment of the invention to provide a high precision winch.

It is another object of an embodiment of the invention to provide a winch capable of engaging multiple bundling belts.

It is another object of an embodiment of the invention to provide a winch that can withstand cold and extreme conditions.

It is another object of an embodiment of the invention to provide a lightweight yet strong belt axle connecting piece.

It is another object of an embodiment of the invention to provide a belt axle connecting piece that is easy to manufacture.

It is another object of an embodiment of the invention to provide a belt axle connecting piece that securely fastens a belt axle to the bracket of a winch.

It is another object of an embodiment of the invention to provide a belt axle connecting piece capable of securing a belt axle comprised of multiple rods.

It is another object of an embodiment of the invention to provide a simple, efficient, durable, and cost effective winch.

To address the aforementioned objectives and other objectives that will become apparent from the description of the invention, one embodiment of the present invention discloses a belt axle connecting piece of a winch.

The winch comprises a bracket and a belt axle axially arranged on the bracket. The belt axle includes three parallel rods arranged along the axial direction. Bundling belts or ropes can be placed within the clearance between any two adjacent rods. Depending on the application, the bundling belt can wrap around one or more of the rods. In addition, multiple bundling belts can also be placed on one or more of the rods.

At the ends of the rods, connecting pieces hold the rods in place on the bracket. Each connecting piece comprises a cylindrical body with three positioning petals located at a proximal end of the body. The three positioning petals are bent toward the center axis of the cylinder, thereby forming primary positioning grooves between every two adjacent positioning petals. The rods are positioned on these primary positioning grooves. The tips of the position petals are generally perpendicular to the center axis of the body, and the bends of the positioning petals form primary attachment grooves for attachment to a circular stationary disk as described below.

For each body, a circular stationary disk is set on the proximal end of the body. The stationary disk has three secondary positioning grooves corresponding to the three primary positioning grooves of the body. Each pair of corresponding positioning grooves forms a circular positioning hole through which a corresponding rod will fit. The sides of the corresponding positioning grooves firmly press against the rods to restrict movement. This assembly results in a stable and secure connection between the rods and the body. Between every two adjacent secondary positioning grooves is a secondary attachment groove for attachment to the body.

The stationary disk can be fixed to the body by welding the secondary attachment grooves to the primary attachment grooves on the body. The corresponding attachment grooves should fit such that the stationary disk rests perpendicular to the center axis of the body when the attachment grooves are connected.

When a bundling belt or rope is looped into the belt axle, it can be tightened by rotating one or both of the cylindrical bodies, which in turn rotates the belt axle. To prevent scoring or damage to the bundling belt, the proximal side of the stationary disk should sit flush with the proximal side of the positioning petal tip.

The belt axle connecting piece of a winch can be manufacturer through the following steps:

(a) stamping a first plate, whereby a plate body is punched from a metallic plate by an ordinary stamping device, creating a one-piece plate that is generally rectangular with three evenly spaced positioning petals along one edge of the plate;

(b) rolling the plate into a cylindrical shape by an ordinary rolling process to form a semi-finished body;

(c) bending the positioning petals 40-degrees to 50-degrees toward the center axis of the body;

(d) further bending the positioning petals so that the tips of the positioning petals are perpendicular to the center axis of the body;

(e) stamping a second plate to form a circular stationary disk by punching out a metallic plate using an ordinary stamping device;

(f) concurrently punching both secondary positioning grooves and secondary attachment grooves on the circular stationary disk;

(g) positioning the circular stationary disk such that the secondary positioning grooves and the secondary attachment grooves align with the primary positioning grooves and the primary attachment grooves, respectively; and (h) fixing the circular stationary disk onto the body by welding the secondary attachment grooves to the primary attachment grooves.

DETAILED DESCRIPTION OF THE INVENTION

Figure 1:
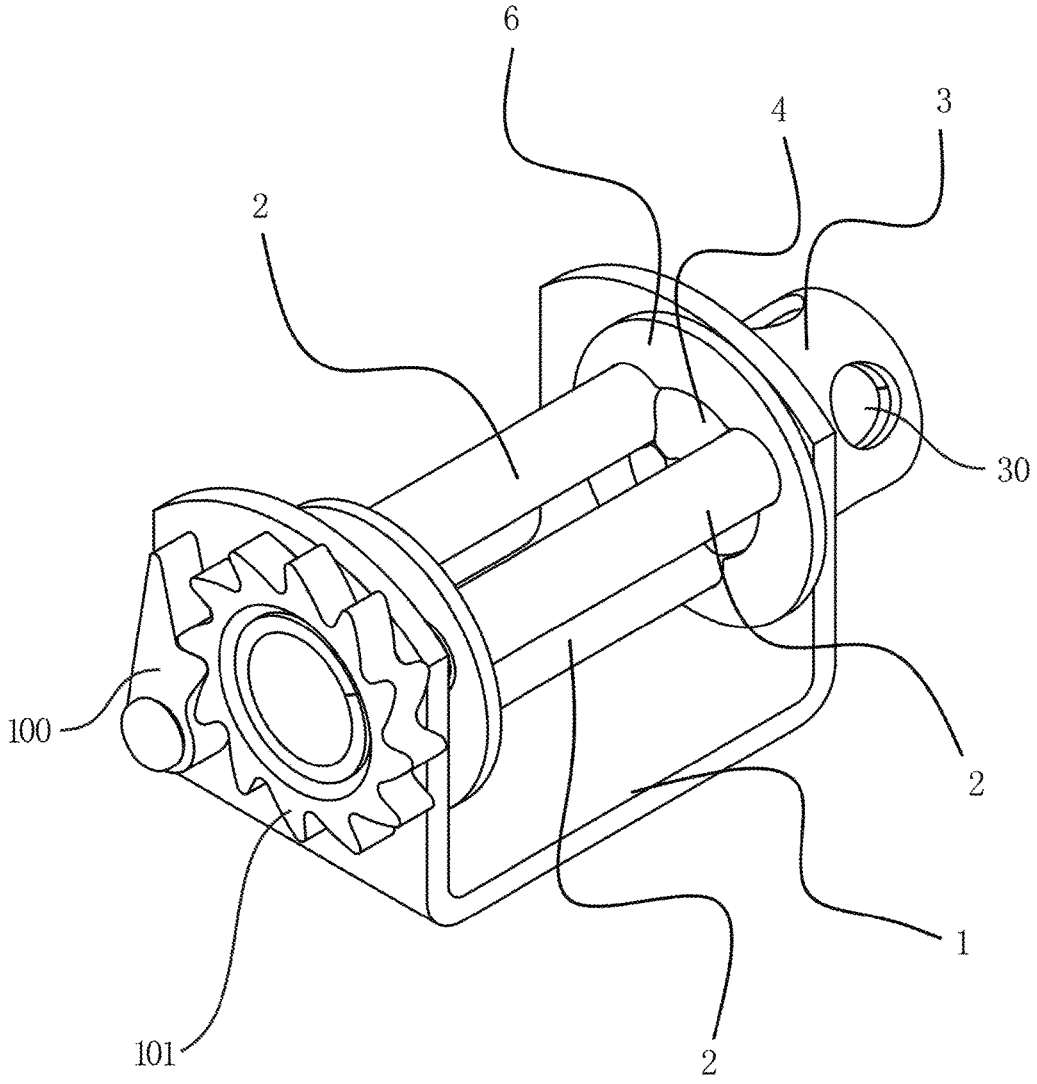
FIG. 1 is a perspective view illustrating a preferred embodiment of a winch according to the present invention.

Referring to the drawings, a description will be made with regards to preferred embodiments of a winch according to the present invention.

Winch

As shown in FIG. 1, a winch comprises a bracket 1, a belt axle axially arranged on the bracket 1, a pawl 100, and a ratchet wheel 101. The belt axle includes three parallel rods 2, held in place on either end of the bracket 1 by a connecting piece. The connecting piece comprises a circular stationary disk 6 and a cylindrical body 3 having three bent positioning petals 4, the positioning petals 4 arranged at a proximal end of the body 3.

The ratchet wheel 101 can be attached to one of the connecting pieces. When the pawl 100 engages the ratchet wheel 101, the belt axle is only rotatable in one direction. A crank or other power source can be directly attached to one of the connecting pieces to power the winch. In one embodiment of the invention, coupling holes 30 are punched into the body 3, which can be used to attach the power source to the body 3.

A bundling belt or rope can be inserted through the clearance between the adjacent rods 2, or wrapped around the entire belt axle. For some applications, multiple bundling belts can be used simultaneously on a single belt axle. To tighten the bundling belt, the power source rotates the belt axle in the direction permitted by the pawl 100. To loosen the bundling belt, the pawl 100 is disengaged from the ratchet wheel 101 and the belt axle is rotated in the reverse direction.

In one preferred embodiment of the invention, the belt axle includes three rods 2 that are equidistant from each other. In a cross-sectional view of this rod arrangement, the rods 2 would line up as corners of an equilateral triangle. This arrangement provides stability while the belt axle rotates. One skilled in the art will recognize that the current invention can utilize any plurality of rods 2 with a variety of different rod arrangements. For example, a cross-shaped arrangement of the rods 2 can be derived using a body 3 with four positioning petals 4. The resulting arrangement would have four rods 2 orbiting a center rod 2.

Connecting Piece

Figure 2:
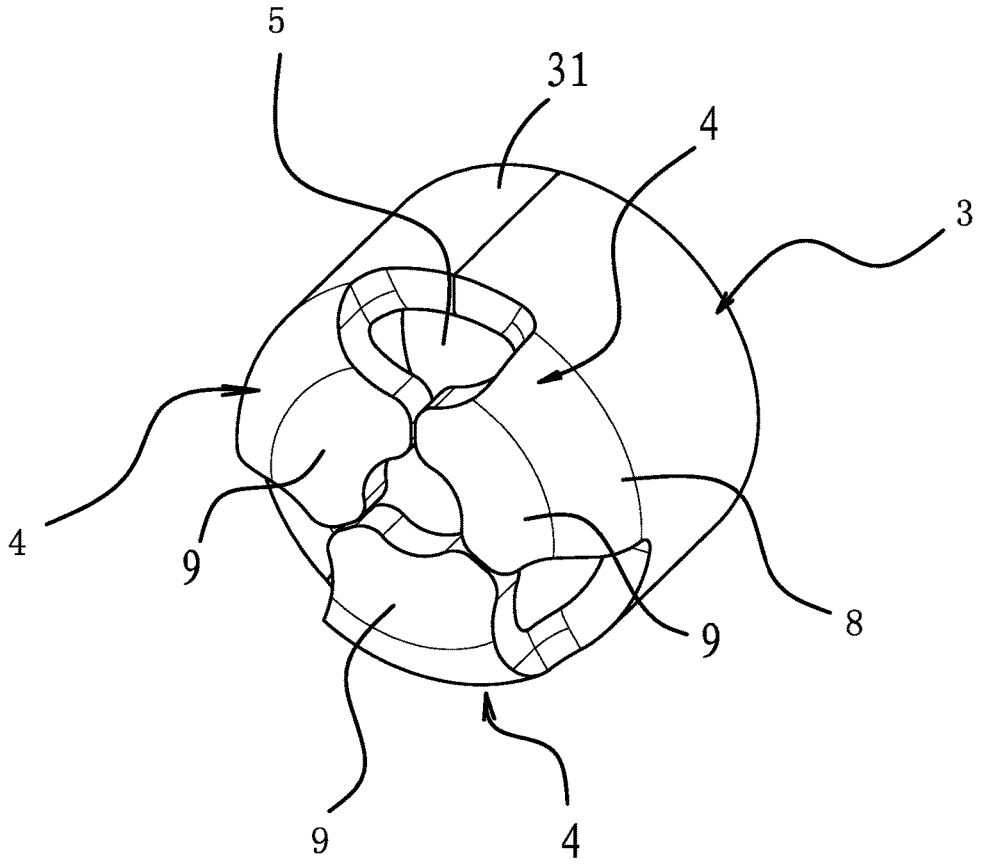
FIG. 2 is a perspective view illustrating a preferred embodiment of a body according to the present invention.

FIG. 2 depicts a preferred embodiment of the body 3. On the proximal end of the body are the three proportionately-spaced positioning petals 4, which are bent such that the petal tips 9 are generally perpendicular to a center axis of the body 3. In this embodiment, the positioning petals 4 are bent toward the center axis of the body 3, although some embodiments of the invention have positioning petals 4 bent away from the center axis of the body 3. The positioning petals 4 form primary positioning grooves 5, on which the rods 2 rest. On the curved bends of the positioning petals 4 are primary attachment grooves 8, which can be used as welding points to attach to the stationary disk 6.

Figure 3:
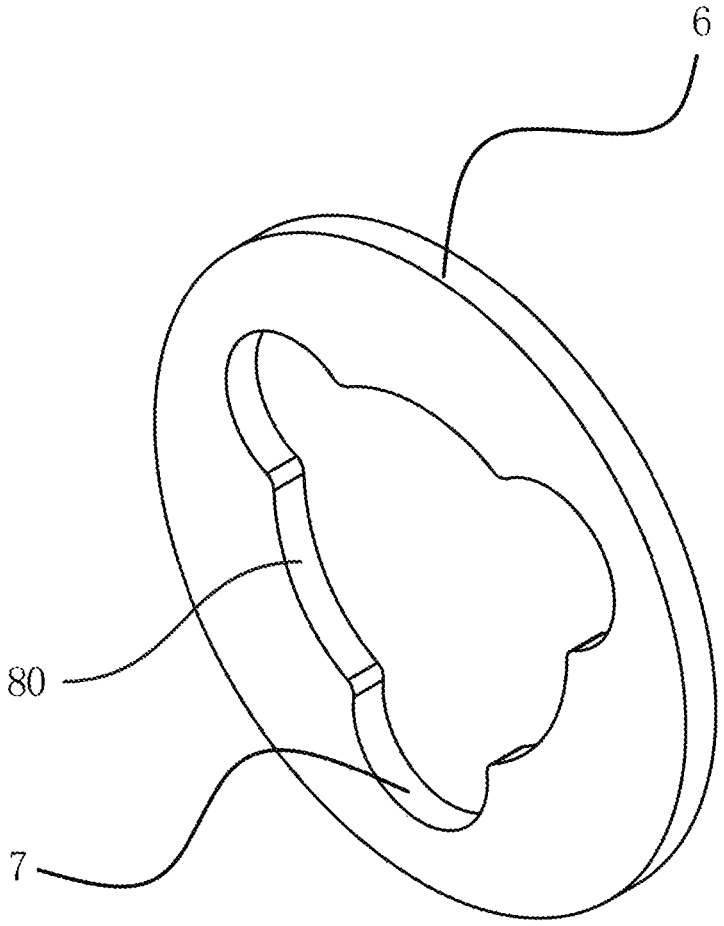
FIG. 3 is a perspective view illustrating a preferred embodiment of a stationary disk according to the present invention.

The circular stationary disk 6 is shown in FIG. 3. Three secondary positioning grooves 7 alternate with three secondary attachment grooves 80 to form an interior ring of the circular stationary disk 6. The secondary positioning grooves 7 and the secondary attachment grooves 80 correspond to the primary positioning grooves 5 and the primary attachment grooves 8, respectively.

Figure 4:
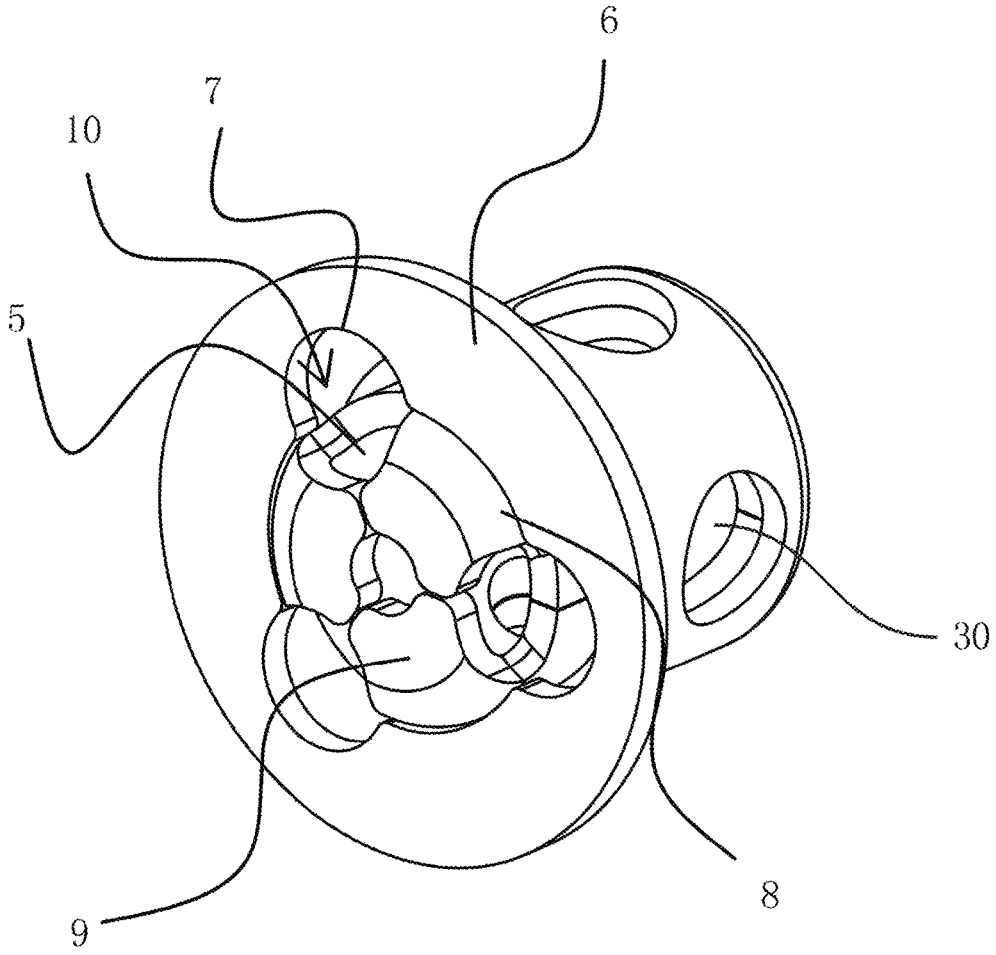
FIG. 4 is a perspective view illustrating a preferred embodiment of the assembled body and stationary disk according to the present invention.

FIG. 4 shows the connecting piece when the body 3 and the stationary disk 6 are properly aligned and assembled. In this assembly, the secondary positioning grooves 7 complement the primary positioning grooves 5 to form positioning holes 10. The positioning holes 10 are designed to snugly fit the rods 2. While the positioning holes 10 in this preferred embodiment are circular and formed by semi-circular primary positioning grooves 5 and semicircular secondary positioning grooves 7, one skilled in the art will recognize that positioning grooves of various shapes and sizes can perform similar functions. For example, a primary positioning groove 5 can be shaped to form three sides of a rectangle with a secondary positioning groove 7 forming the fourth side, and vice versa. Similarly, positioning holes 10 can be punched in either or all of the primary positioning grooves 5 or secondary positioning grooves 7.

In one embodiment of the connecting piece, the secondary attachment grooves 80 sit on the primary attachment grooves 8 such that a proximal face of the petal tip 9 sits flush with a proximal face of the stationary disk 6. The secondary attachment grooves 80 are welded or otherwise affixed onto the primary attachment grooves 8.

The belt axle connecting piece can be manufacturer by the following steps. First, a plate body is punched from a metallic plate by an ordinary stamping device. The resulting plate 31 is generally rectangular with three evenly spaced positioning petals 4 along one edge of the plate 31. Embodiments with alternative spacing and different numbers of positioning petals 4 can also be used.

Next, the plate 31 is rolled into a cylindrical shape by an ordinary rolling process to form a semi-finished cylindrical body 3. Other polygonal embodiments can also be manufactured by pressing and stamping the body 3.

After rolling the body 3, the positioning petals 4 are bent and molded about 40-degrees to 50-degrees toward the center axis of the body 3. This preform avoids stressing the ductility of the materials. The body 3 can crack or rupture if it is bent the entire 90 degrees at one time. Such stress can also make the material more brittle. After making the preform, further bending and molding is done to the positioning petals 4 so that the petals tips 9 are generally perpendicular to the center axis of the body 3.

The circular stationary disk 6 is formed by punching out a metallic plate using an ordinary stamping device. It is preferred that the secondary positioning grooves 7 and the secondary attachment grooves 80 on the stationary disk 6 are simultaneously punched to ensure high precision and accuracy of the positions of the grooves.

Next, the stationary disk 6 is positioned such that the secondary positioning grooves 7 and the secondary attachment grooves 80 align with the primary positioning grooves 5 and the primary attachment grooves 8, respectively. Once aligned, the primary positioning grooves 5 and the secondary positioning grooves 7 form circular positioning holes 10, through which the rods 2 can securely be held in place.

Once the proper alignment is made, the stationary disk 6 is fixed onto the body 3 by welding the secondary attachment grooves 7 to the primary attachment grooves 8. The resulting connecting piece is simple in structure and convenient to manufacture. Because the connecting piece is not solidly cast, it avoids many disadvantages of the prior art, including high cost and low reliability. The present invention is reliable, has a simple structure that is easy and inexpensive to manufacture, and is easily replaceable and repairable.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

| List of Reference Numerals | |
|---|---|
| 1 | bracket |
| 2 | rod |
| 3 | body |
| 31 | plate |
| 4 | positioning petal |
| 5 | primary positioning groove |

-continued

| List of Reference Numerals | |
|---|---|
| 6 | stationary disk |
| 7 | secondary positioning groove |
| 8 | primary attachment groove |
| 9 | petal tip |
| 10 | positioning hole |
| 30 | coupling hole |
| 80 | secondary attachment groove |
| 100 | pawl |
| 101 | ratchet wheel |

What is claimed is:

1. A method for manufacturing a belt axle connecting piece of a winch, comprising:

(a) stamping to get a first plate (31) that is generally rectangular with a plurality of evenly spaced positioning petals (4) along one edge of the first plate (31);

(b) rolling the first plate (31) into a cylindrical shape by a rolling process; and (c) bending the positioning petals (4) to form tips (9) and the tips (9) of the positioning petals (4) are generally perpendicular to a center axis of the first plate (31), thereby forming primary positioning grooves (5) between every two adjacent positioning petals (4), the primary positioning grooves (5) capable of securing rods (2) in place on the winch.

2. The method as claimed in claim 1, wherein between the step of rolling the first plate (31) and the step of bending the positioning petals (4), the positioning petals (4) are bent about 40-degrees to 50-degrees toward the center axis of the first plate (31) before being bent generally perpendicular to the center axis of the first plate (31).

3. The method as claimed in claim 2, further comprising:

(d) stamping to get a circular stationary disk (6) and concurrently stamping secondary positioning grooves (7) onto the stationary disk (6).

4. The method as claimed in claim 1, further comprising:

(d) stamping to get a circular stationary disk (6) and concurrently stamping secondary positioning grooves (7) onto the stationary disk (6).

5. The method as claimed in claim 3, further comprising:

(e) welding the stationary disk (6) to the first plate (31) after the secondary positioning grooves (7) align with the primary positioning grooves (5).

6. The method as claimed in claim 4, further comprising:

(e) welding the stationary disk (6) to the first plate (31) after the secondary positioning grooves (7) align with the primary positioning grooves (5).

* * * * *